US006702209B2

(12) United States Patent
Furlani et al.

(10) Patent No.: US 6,702,209 B2
(45) Date of Patent: Mar. 9, 2004

(54) ELECTROSTATIC FLUID EJECTOR WITH DYNAMIC VALVE CONTROL

(75) Inventors: Edward P. Furlani, Lancaster, NY (US); Michael J. Debar, Rochester, NY (US); Christopher N. Delametter, Rochester, NY (US); Gilbert A. Hawkins, Mendon, NY (US); Constantine N. Anagnostopoulos, Mendon, NY (US)

(73) Assignee: Eastman Kodak Company, Rochester, NY (US)

( * ) Notice: Subject to any disclaimer, the term of this patent is extended or adjusted under 35 U.S.C. 154(b) by 25 days.

(21) Appl. No.: 10/138,908

(22) Filed: May 3, 2002

(65) Prior Publication Data

US 2003/0205630 A1 Nov. 6, 2003

(51) Int. Cl.[7] ..... B05B 3/00
(52) U.S. Cl. ..... 239/690; 347/54
(58) Field of Search ..... 239/690, 690.1, 239/697, 698, 706; 347/54, 56, 61, 65, 70, 75

(56) References Cited

U.S. PATENT DOCUMENTS 4,520,375 A 5/1985 Kroll
5,644,341 A 7/1997 Fujii et al.
5,668,579 A 9/1997 Fujii et al.
5,739,831 A 4/1998 Nakamura et al.
6,127,198 A 10/2000 Coleman et al.
6,318,841 B1 11/2001 Coleman et al.
6,435,666 B1 * 8/2002 Trauernicht et al. ..... 347/54
6,460,972 B1 * 10/2002 Trauernicht et al. ..... 347/54
2001/0023523 A1 9/2001 Kubby et al.

* cited by examiner

*Primary Examiner*—Michael Mar
*Assistant Examiner*—Thach H Bui
(74) *Attorney, Agent, or Firm*—Milton S. Sales

(57) ABSTRACT

A drop-on-demand liquid emission device, such as for example an ink jet printer, includes a member movable through a path for driving liquid from the device, wherein the speed at which the member moves is reduced over the time period that liquid is being expelled. During that time period, a portion of the liquid flows through a passage away from the nozzle orifice. According to a feature of the present invention, a variable flow restrictor increases the resistance to flow through the passage during the time period that liquid is being expelled; thereby tending to compensate for the reduction of the liquid-expulsion force over the time period. The result is a reduction of undesirable satellite droplets following a main drop.

11 Claims, 3 Drawing Sheets

ELECTROSTATIC FLUID EJECTOR WITH DYNAMIC VALVE CONTROL

CROSS REFERENCE TO RELATED APPLICATIONS

Reference is made to commonly assigned, U.S. patent applications Ser. No. 10/122,566 filed Apr. 15, 2002, in the names of Christopher N. Delametter et al., entitled DROP-ON-DEMAND LIQUID EMISSION USING INTERCONNECTED DUAL ELECTRODES AS EJECTION DEVICE; and Ser. No. 09/788,797 filed Feb. 19, 2001, in the names of Ravi Sharma et al., entitled IMPROVED DROP-ON-DEMAND INK JET PRINTING WITH CONTROLLED FLUID FLOW DURING DROP EJECTION.

FIELD OF THE INVENTION

The present invention relates generally to drop-on-demand liquid emission devices such as, for example, ink jet printers, and more particularly such devices which employ an electrostatic actuator for driving liquid from the device.

BACKGROUND OF THE INVENTION

Drop-on-demand (DOD) liquid emission devices with electrostatic actuators are known for ink printing systems. U.S. Pat. Nos. 4,520,375; 5,644,341 and 5,668,579 disclose such devices having electrostatic actuators composed of a diaphragm and opposed electrode. The diaphragm is distorted by application of a first voltage to the electrode. Relaxation of the diaphragm expels an ink droplet from a nozzle orifice. Other devices that operate on the principle of electrostatic attraction are disclosed in U.S. Pat. Nos. 5,739,831, 6,127,198, and 6,318,841; and in U.S. Pub. No. 2001/0023523. According to the prior art, an electrostatic attraction force is applied in a single direction, as the electrodes can only attract; repulsion being impractical. Thus, the devices must rely on the elastic memory of the diaphragm to return to an at-rest position.

Devices that rely on the elastic memory of the diaphragm to expel liquid drops exhibit a reduction on the liquid-expulsion force over the time period that liquid is being expelled. That is, the speed at which the diaphragm moves as it approached its at-rest position decreases. The result is a tendency for liquid to be expelled at a greater velocity at the beginning of the time period and a lesser velocity at the end of the time period. This often results in the production of undesirable satellite droplets following a main drop.

It is known that the force that expels drops from the emission device also causes some liquid to flow backward toward the liquid reservoir. The backward flow of liquid diverted from the nozzle orifice further reduces the velocity of the liquid being emitted from the nozzle orifice.

SUMMARY OF THE INVENTION

A drop-on-demand liquid emission device, such as for example an ink jet printer, includes a member movable through a path for driving liquid from the device, wherein the speed at which the member moves is reduced over the time period that liquid is being expelled. During that time period, a portion of the liquid flows through a passage away from the nozzle orifice. According to a feature of the present invention, a variable flow restrictor increases the resistance to flow through the passage during the time period that liquid is being expelled; thereby tending to compensate for the reduction of the liquid-expulsion force over the time period. The result is a reduction of undesirable satellite droplets following a main drop.

DETAILED DESCRIPTION OF THE INVENTION

The invention has been described in detail with particular reference to certain preferred embodiments thereof, but it will be understood that variations and modifications can be effected within the spirit and scope of the invention.

As described in detail herein below, the present invention provides an apparatus and method of operating a drop-on-demand liquid emission device. The most familiar of such devices are used as printheads in ink jet printing systems. Many other applications are emerging which make use of devices similar to ink jet printheads, but which emit liquids (other than inks) that need to be finely metered and deposited with high spatial precision. The inventions described below provide apparatus and methods for operating drop emitters based on electrostatic actuators so as to improve energy efficiency and overall drop emission productivity.

Figure 1:
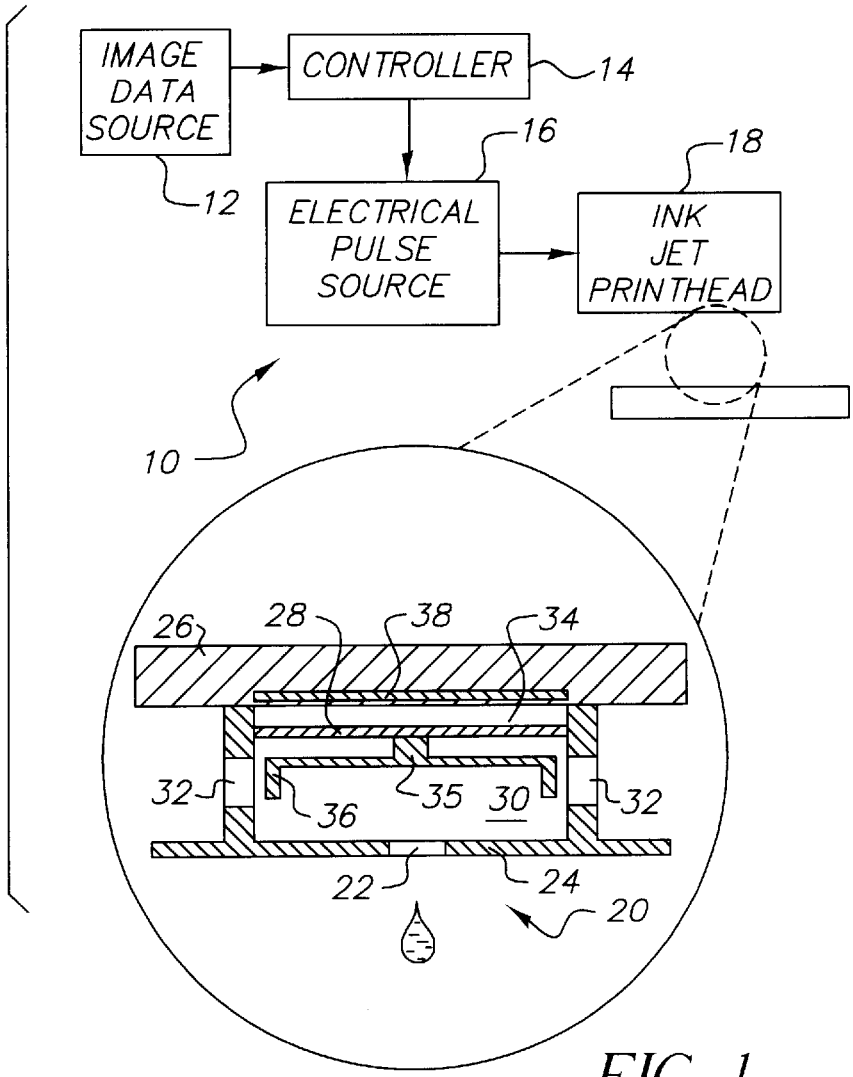
FIG. 1 is a schematic illustration of a drop-on-demand liquid emission device according to the present invention.

FIG. 1 shows a schematic representation of a drop-on-demand liquid emission device 10, such as an ink jet printer, which may be operated according to the present invention. The system includes a source 12 of data (say, image data) which provides signals that are interpreted by a controller 14 as being commands to emit drops. Controller 14 outputs signals to a source 16 of electrical energy pulses which are inputted to a drop-on-demand liquid emission device such as an ink jet printer 18.

Figure 2:
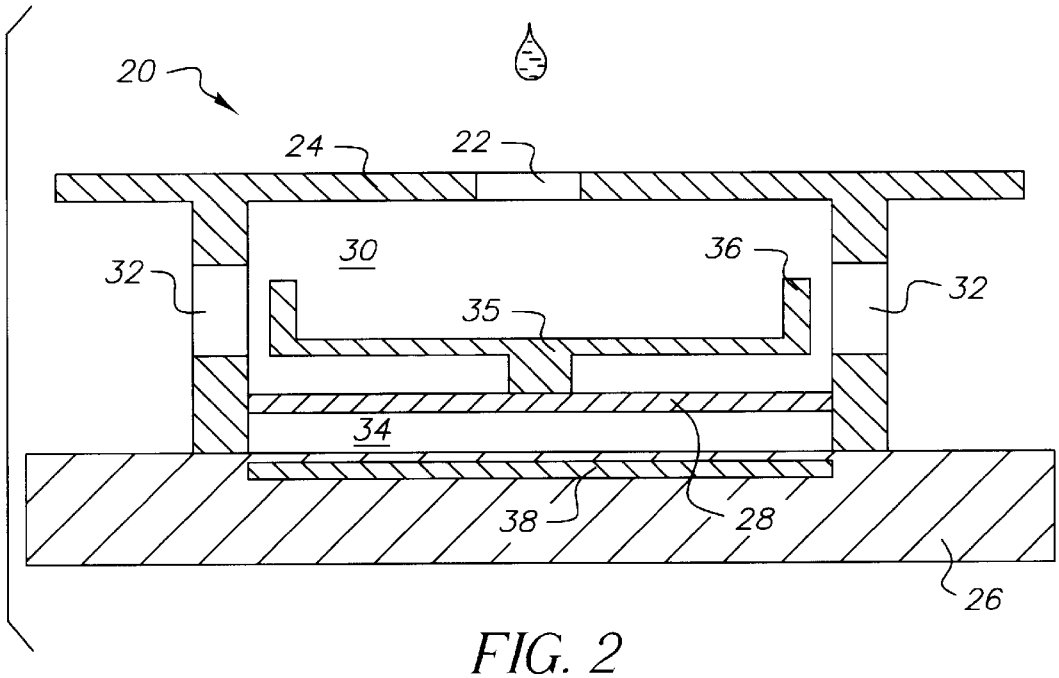
FIG. 2 is a cross-sectional view of a portion of drop-on-demand liquid emission device of FIG. 1.

Drop-on-demand liquid emission device 10 includes a plurality of electrostatic drop ejection mechanisms 20. FIG. 2 is a cross-sectional view of one of the plurality of electrostatically actuated drop ejection mechanisms 20. A nozzle orifice 22 is formed in a nozzle plate 24 for each mechanism 20. A wall or walls 26 that carry an electrically addressable electrode 28 bound each drop ejection mechanism 20. The outer periphery of electrode 28 is sealingly attached to wall 26 to define a liquid chamber 30 adapted to receive the liquid, such as for example ink, to be ejected from nozzle orifice 22. The liquid is drawn into chamber 30 through one or more ports 32 from a supply, not shown. Ports 32 are sized as discussed below. Dielectric fluid fills the region 34 on the side of electrode 28 opposed to chamber 30. The dielectric fluid is preferably air or other dielectric gas, although a dielectric liquid may be used. Addressable electrode 28 is preferably at least partially flexible and carries a rigid piston 35. The piston has baffle members 36 aligned with ports 32. A ground electrode 38 is generally axially aligned with addressable electrode 28 and nozzle orifice 22.

Figure 5:
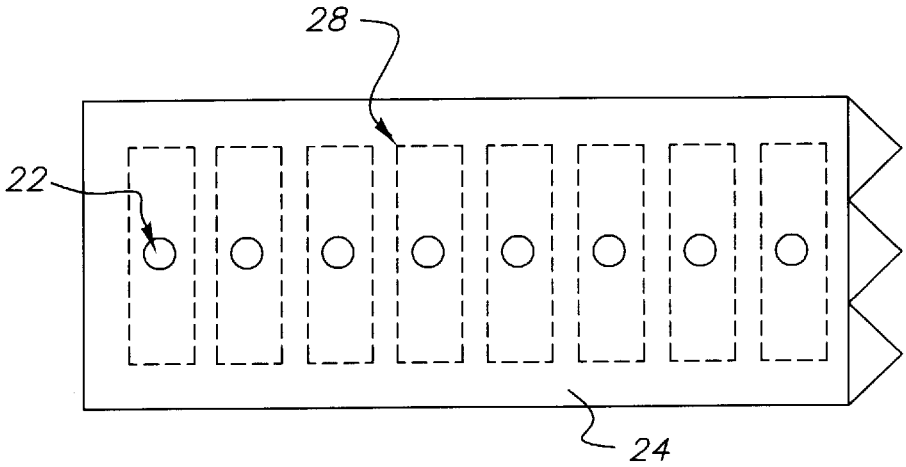
FIGS. 3–5 are top plan views of alternative embodiments of a nozzle plate of the drop-on-demand liquid emission device of FIGS. 1 and 2.
Figure 3:
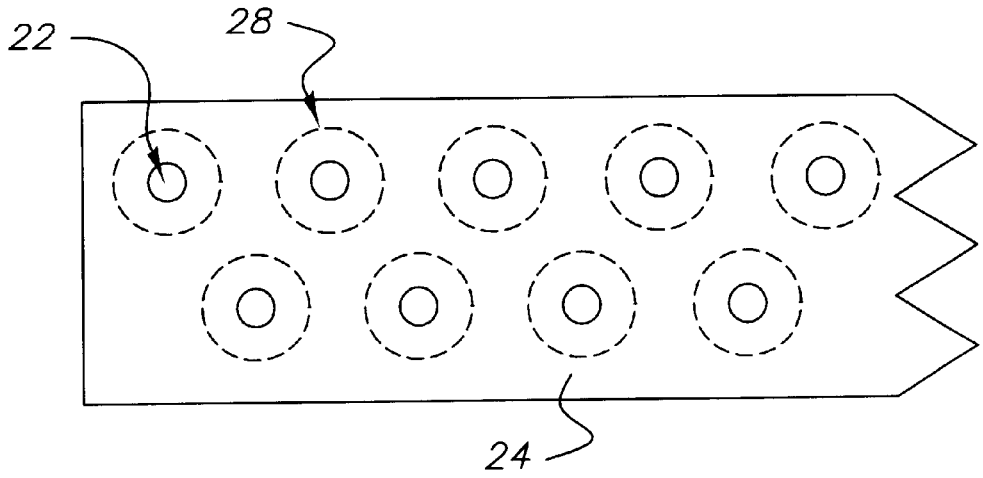
Figure 4:
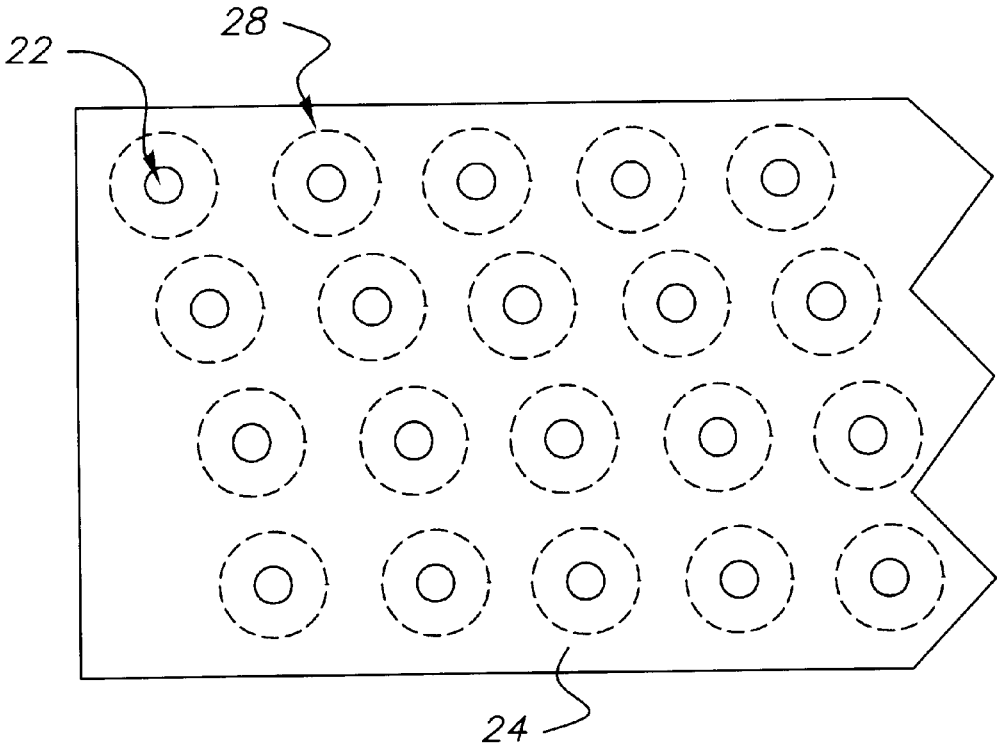

FIGS. 3–5 are top plan views of nozzle plate 24, showing several alternative embodiments of layout patterns for the several nozzle orifices 22 of a print head. Note that in FIGS. 2 and 3, the interior surface of walls 26 are annular, while in FIG. 5, walls 26 form rectangular chambers. Other shapes are of course possible, and these drawings are merely intended to convey the understanding that alternatives are possible within the spirit and scope of the present invention.

Figure 6:
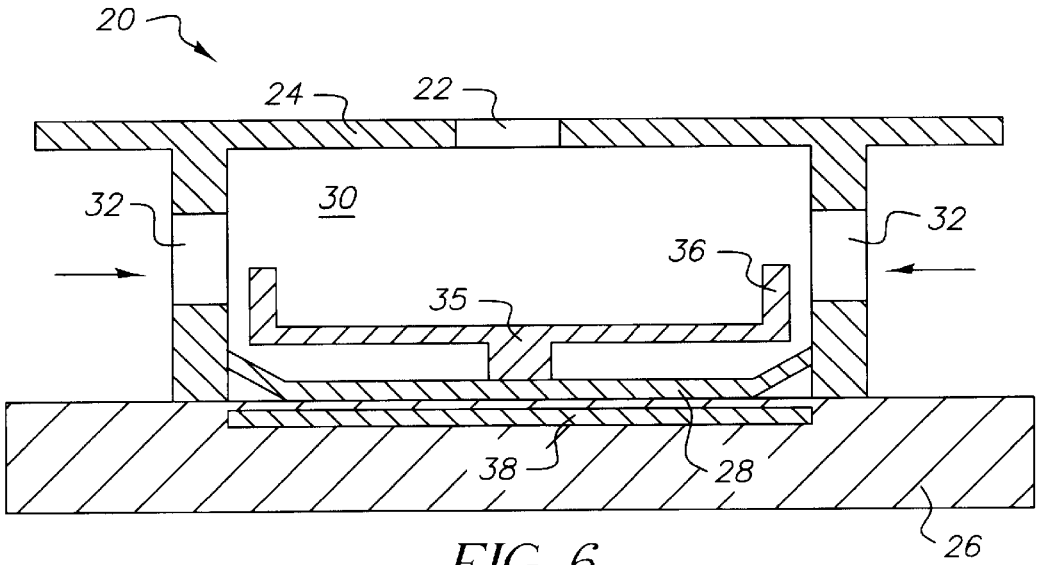
FIG. 6 is a cross-sectional view of the drop-on-demand liquid emission device of FIG. 2 shown in an actuation stage.

Referring to FIG. 6, to eject a drop, an electrostatic charge is applied to the addressable electrode 28, which pulls that electrode toward ground electrode 38 and away from the nozzle orifice, as indicated. Since this electrode forms a wall portion of liquid chamber 30 behind the nozzle orifice, movement of electrode 28 away from nozzle plate 24 expands the chamber, drawing liquid through ports 32, past opening baffles 36, and into the expanding chamber 30.

Subsequently (say, several microsecond later) addressable electrode 28 is de-energized, causing addressable electrode 28 to return from the state illustrated in FIG. 6 towards its state depicted in FIG. 2 under the sole force of stored elastic potential energy in the system. This action pressurizes the liquid in chamber 30 behind the nozzle orifice, causing a drop to be ejected from the nozzle orifice with an initial velocity. A fair amount of liquid escapes from chamber 30 through ports 32, which should be properly sized to present sufficiently low flow resistance so that filling of chamber 30 is not significantly impeded when electrode 38 is energized, and yet present sufficiently high flow resistance so that the back flow of liquid through the ports is not of serious consequence.

As the movement of piston 35 progresses towards nozzle orifice 22, more and more of ports 32 are covered by moving baffles 36. This increases the flow resistance through the ports (variably restricting flow through ports 32) at the same time that the force of stored elastic potential energy in the system is decreasing. Thus, a greater percentage of displaced liquid is ejected through nozzle orifice 22 rather than through ports 32. This tends to cancel out the tendency for liquid to be expelled through nozzle orifice 22 at a greater velocity at the beginning of the time period and a lesser velocity at the end of the time period. This, in turn, inhibits the production of undesirable satellite droplets following a main drop.

The foregoing description of preferred embodiments of the invention has been presented for purposes of illustration and description. It is not intended to be exhaustive or to limit the invention to the precise form disclosed. Modification and variations are possible and will be recognized by one skilled in the art in light of the above teachings. Such additional embodiments fall within the spirit and scope of the appended claims.

What is claimed is:

1. An emission device for ejecting a liquid drop, said device comprising:

a structure defining a chamber volume adapted to receive a liquid and having a nozzle orifice through which a drop of received liquid can be emitted;

a wall portion of the chamber volume defining structure, said wall portion being adapted for movement in:

a first direction to increase the chamber volume to draw liquid into the chamber volume through the supply port, and a second direction to decrease the chamber volume to emit a liquid drop through the nozzle orifice and through the supply port;

a variable flow restrictor adapted to progressively increase resistance to flow of liquid through the liquid supply port during movement of the wall portion in said second direction; and a controller adapted to selectively move the wall portion in said first and second directions.

2. An emission device as defined in claim 1 wherein the restrictor is rigidly attached to the wall portion.

3. An emission device for ejecting a liquid drop, said device comprising:

a structure defining a chamber volume adapted to receive a liquid and having a nozzle orifice through which a drop of received liquid can be emitted;

an electrode associated with a movable wall portion of the chamber volume defining structure such that electrical actuation of the electrode moves the movable wall portion in:

a first direction to increase the chamber volume to draw liquid into the chamber volume through the supply port, and a second direction to decrease the chamber volume to emit a liquid drop through the nozzle orifice and through the supply port;

a variable flow restrictor adapted to progressively increase resistance to flow of liquid through the liquid supply port during movement of the wall portion in said second direction; and a controller adapted to selectively electrically actuate the electrode.

4. An emission device for ejecting a liquid drop as defined in claim 3, wherein the moveable wall portion is disposed in the chamber volume defining structure in opposed alignment with the nozzle orifice.

5. An emission device for ejecting a liquid drop as defined in claim 3, wherein the moveable wall portion is circular in shape.

6. An emission device for ejecting a liquid drop as defined in claim 3, wherein the moveable wall portion is rectangular in shape.

7. An emission device for ejecting a liquid drop as defined in claim 3, wherein the emission device is a print head of an ink jet printing system.

8. An emission device as defined in claim 3 wherein the restrictor is rigidly attached to the wall portion.

9. An emission device for ejecting a liquid drop, said device comprising:

a structure defining a chamber volume adapted to receive a liquid and having a nozzle orifice through which a drop of received liquid can be emitted;

a wall portion of the chamber volume defining structure, said wall portion being movable such that movement of the wall portion in:

a first direction increases the chamber volume to draw liquid into the chamber volume through the supply port, and a second direction decreases the chamber volume to emit a liquid drop through the nozzle orifice and through the supply port;

an electrode in opposition to the wall portion such that:

application of an electrostatic charge differential between the wall portion and the electrode moves the wall portion in said first direction to increase the chamber volume and relaxation of the electrostatic charge differential between the wall portion and the electrode moves the wall portion in said second direction to decrease the chamber volume; and a variable flow restrictor adapted to progressively increase resistance to flow of liquid through the liquid supply port during movement of the wall portion in said second direction; and a controller adapted to selectively electrically actuate the electrode.

10. An emission device as defined in claim 9 wherein the electrode is a structurally stiff ground electrode.

11. An emission device as defined in claim 9 wherein the restrictor is rigidly attached to the wall portion.

* * * * *